US006793838B2

(12) United States Patent
Hansen et al.

(10) Patent No.: US 6,793,838 B2
(45) Date of Patent: Sep. 21, 2004

(54) CHEMICAL MILLING PROCESS AND SOLUTION FOR CAST TITANIUM ALLOYS

(75) Inventors: James O. Hansen, Glastonbury, CT (US); Kenneth C. Long, Stuart, FL (US); Michael A. Jackson, Springboro, OH (US); Henry M. Hodgens, Rockville, CT (US)

(73) Assignee: United Technologies Corporation, Hartford, CT (US)

( * ) Notice: Subject to any disclaimer, the term of this patent is extended or adjusted under 35 U.S.C. 154(b) by 279 days.

(21) Appl. No.: 09/967,098

(22) Filed: Sep. 28, 2001

(65) Prior Publication Data

US 2003/0066818 A1 Apr. 10, 2003

(51) Int. Cl.[7] ..... C23F 1/00

(52) U.S. Cl. ..... 216/100; 216/102; 216/105; 216/106; 216/107; 216/108; 216/109

(58) Field of Search ..... 216/100, 102, 216/105–109

(56) References Cited

U.S. PATENT DOCUMENTS 3,788,914 A * 1/1974 Gumbelevicius ..... 216/109
3,844,859 A * 10/1974 Roni ..... 216/109
3,936,316 A * 2/1976 Gulla ..... 134/3
3,944,496 A * 3/1976 Coggins et al. ..... 252/79.3
4,116,755 A * 9/1978 Coggins et al. ..... 216/109
4,275,100 A * 6/1981 Datta ..... 369/286
4,556,449 A * 12/1985 Nelson ..... 216/108
4,563,239 A * 1/1986 Adinolfi et al. ..... 216/91
4,900,398 A * 2/1990 Chen ..... 216/109
5,102,499 A * 4/1992 Jodgens et al. ..... 216/109
5,173,368 A * 12/1992 Belmares ..... 428/426
5,217,569 A * 6/1993 Hodgens et al. ..... 216/109

* cited by examiner

*Primary Examiner*—Anita Alanko
(74) *Attorney, Agent, or Firm*—Bachman & LaPointe, P.C.

(57) ABSTRACT

The present invention relates to a chemical milling solution and a chemical milling process for removing a desired depth of material from metal parts. The milling solution contains nitric acid, hydrofluoric acid, a wetting agent, such as a surfactant, dissolved titanium, and the balance water. The solution is maintained at a temperature in the range of from about 110° F. to about 130° F. The metal part to be milled is immersed in the milling solution for a time sufficient to remove a desired depth of material from at least one surface of the part.

15 Claims, 4 Drawing Sheets

CHEMICAL MILLING PROCESS AND SOLUTION FOR CAST TITANIUM ALLOYS

U.S. GOVERNMENT RIGHTS

The Government may have rights in this invention, pursuant to Contract No. N00019-97-C-0050, awarded by the United States Navy.

BACKGROUND OF THE INVENTION

The present invention relates to a process for chemically milling parts formed from a metallic material, in particular, a titanium alloy, and to a milling solution used to mill such parts.

Chemical milling of castings formed from titanium alloys such as Ti 6-2-4-2 (a titanium based alloy containing 6 wt % aluminum, 2 wt % tin, 4 wt % zirconium, 2 wt % molybdenum, and the balance essentially titanium) generally results in unacceptable intergranular attack which results in an approximate 10×debit in low cycle fatigue life and a corresponding decrease in high cycle fatigue capability. This impacts fatigue limited parts formed from chemically milled titanium alloys such as stator vanes and casings on jet engines.

Thus, there is a need for a process and a milling solution which allows desired metal removal without the occurrence of significant intergranular attack.

SUMMARY OF THE INVENTION

Accordingly, it is an object of the present invention to provide a chemical milling process for parts which avoids the occurrence of significant intergranular attack.

It is a further object of the present invention to provide an improved chemical milling solution for carrying out the aforementioned chemical milling process.

The foregoing objects are attained by the chemical milling process of the present invention and the novel chemical milling solution of the present invention.

In accordance with the present invention, a process for chemically milling a metallic part without causing significant intergranular attack broadly comprises the steps of: providing a milling solution containing nitric acid, hydrofluoric acid, dissolved titanium, a wetting agent, and water; maintaining the milling solution at a temperature in the range of from about 110° F. to 130° F.; and immersing said part formed from a titanium alloy in the milling solution for a time sufficient to mill a desired depth on at least one surface of the part.

In accordance with the present invention, a solution for chemically milling a metal part formed without causing significant intergranular attack is formed from nitric acid, hydrofluoric acid, dissolved titanium, a wetting agent, and the balance water.

Other details of the chemical milling process and the chemical milling solution of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
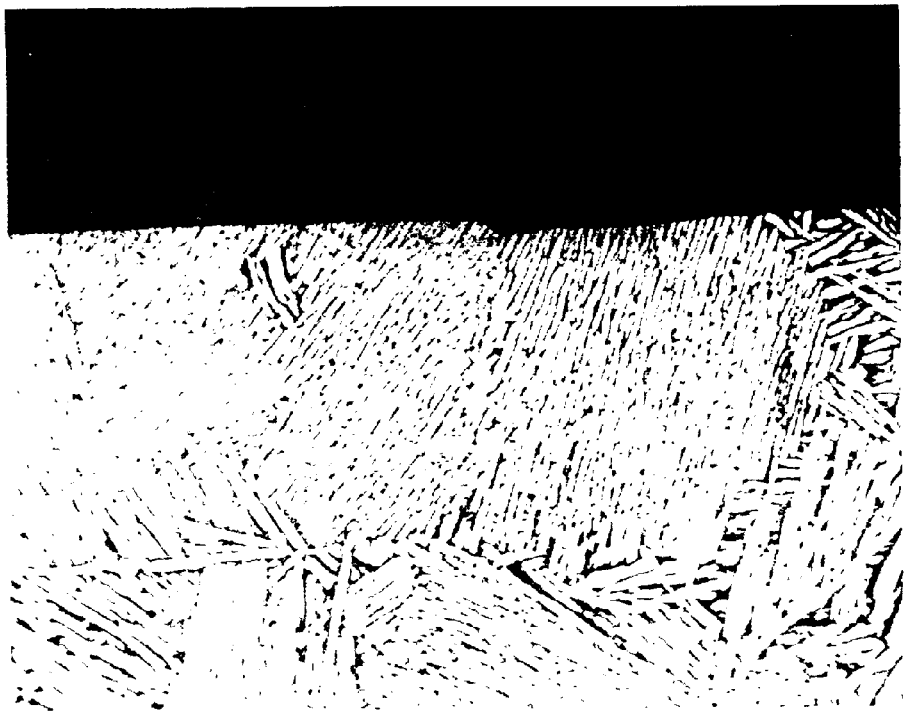
FIGS. 1–4 are photomicrographs showing the intergranular attack results of two trials using chemical milling solutions in accordance with the present invention to remove 0.020" per side at a magnification of 200×.
Figure 2:
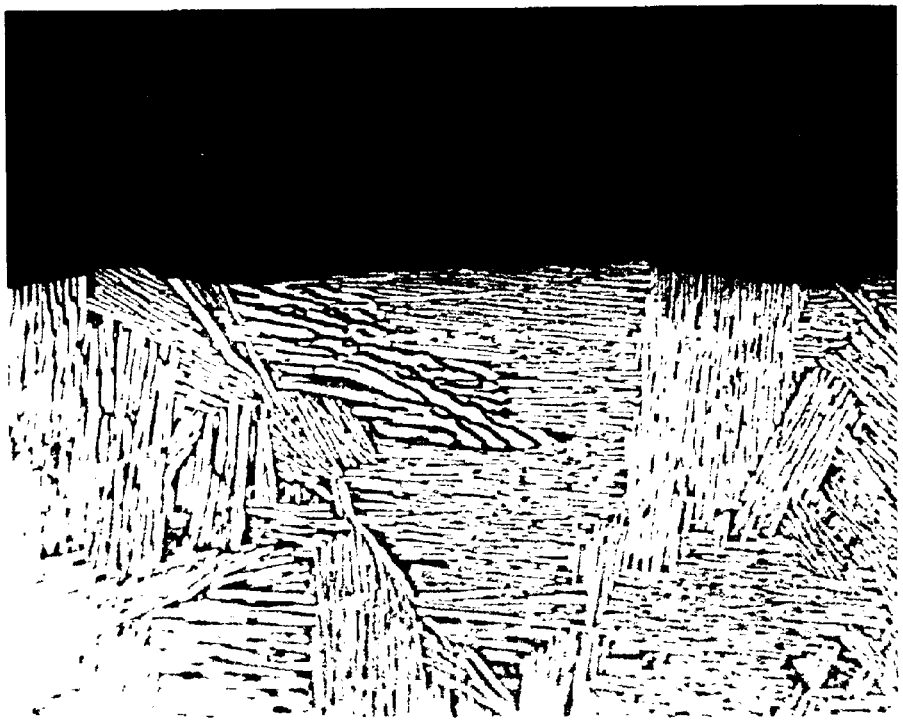
Figure 3:
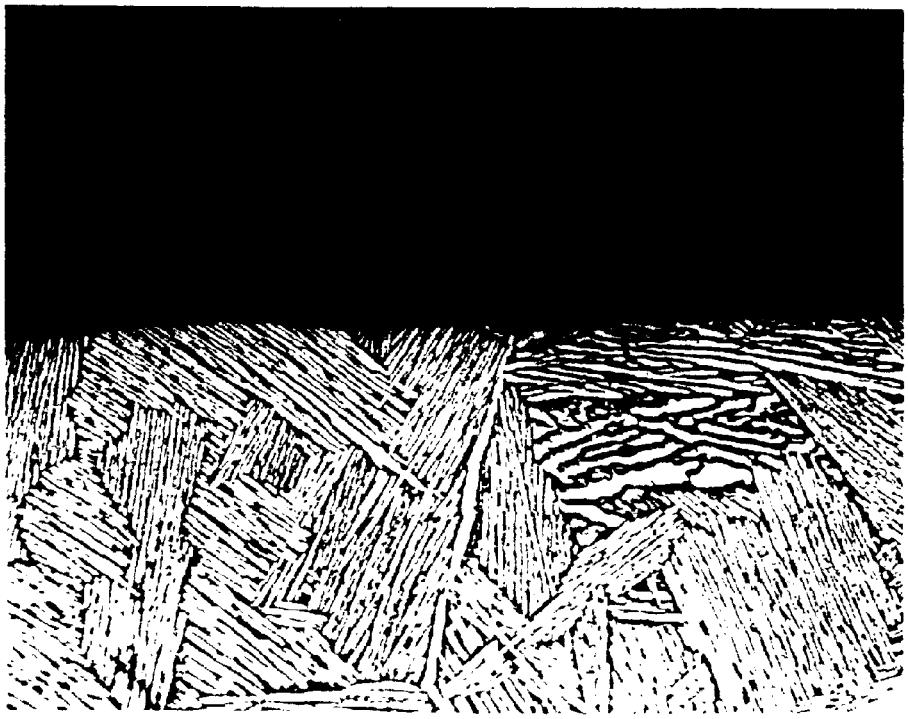
Figure 4:
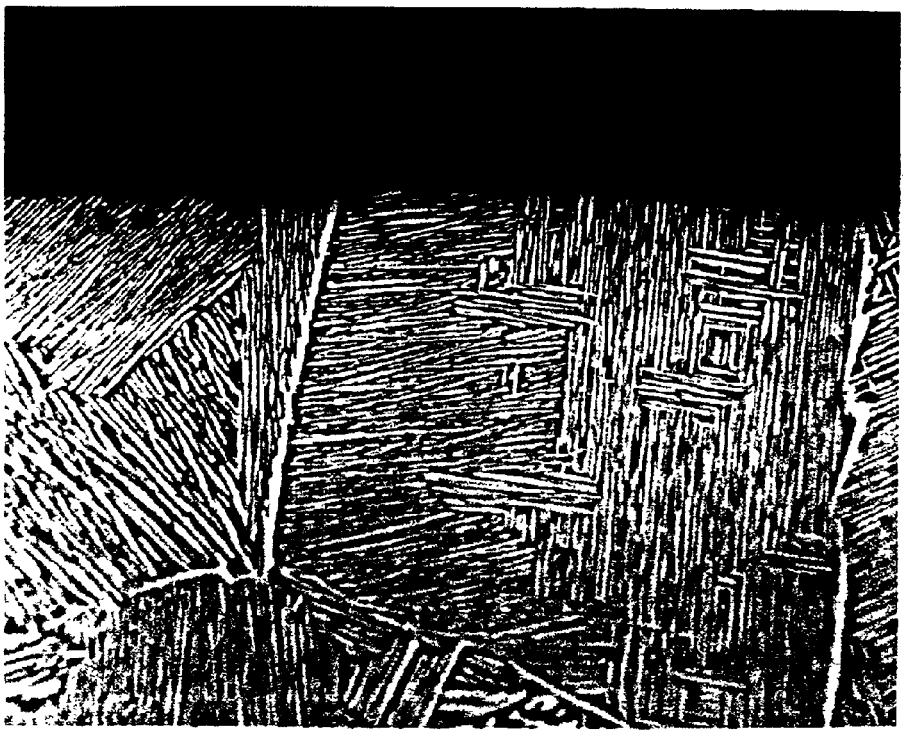

Various parts used on turbine engines are cast from metallic titanium based alloys. A common metallic material used for these parts is a titanium alloy designated Ti 6-2-4-2. These cast parts need to be chemically milled to remove the alpha case which results from the mold to metal reaction or a high temperature thermal exposure. Typically, up to about 0.020" per side is removed to eliminate the alpha case. This removal operation typically involves immersing the cast metal part into a chemical milling solution for a time period sufficient to remove a desired depth of material from the part.

In accordance with the present invention, a chemical milling solution for milling metal parts, preferably formed from titanium based alloys, without producing significant intergranular attack has been designed. The chemical milling solution contains nitric acid, hydrofluoric acid, dissolved titanium, a wetting agent, and the balance water. The wetting agent preferably is present in an amount sufficient to create a surface tension in the range of about 30 to 36 dynes/cm$^2$. The nitric acid and hydrofluoric acid constituents are present in a $HNO_3$/HF ratio in the range of from about 1:1 to about 2:1, preferably from about 1:1 to about 1.5:1, and most preferably about 1:1. During use, the solution should be maintained at a temperature in the range of from about 110° F. to about 130° F., preferably from about 115° F. to about 125° F. The dissolved titanium in the solution should be present in an amount less than about 2.5 oz./gal.

When the $HNO_3$/HF ratio is in the range of 1:1 to 2:1 and the solution temperature is in the range of from about 110° F. to about 130° F., the dissolved titanium may be present in an amount up to about 0.5 oz./gal. When the $HNO_3$/HF ratio is in the range of from about 1:1 to about 1.5:1 and the solution temperature is in the range of from about 115° F. to about 125° F., the dissolved titanium may be present in an amount up to about 1.5 oz./gal. When the $HNO_3$/HF ratio is about 1:1 and the solution temperature is in the range of from about 115° F. to about 125° F., the dissolved titanium may be present in an amount up to about 2.5 oz./gal. This information is summarized in Table I.

TABLE I

| | Surface Tension (dynes/cm$^2$) | $HNO_3$/HF Ratio | Temperature (° F.) | Dissolved Ti (oz/gal) |
|---|---|---|---|---|
| Solution Limits | 30–36 | 1.0–2.0 | 110–130 | 0.0–0.5 |
| Solution Limits | 30–36 | 1.0–1.5 | 115–125 | 0.5–1.5 |
| Solution Limits | 30–36 | ~1.0 | 115–125 | 1.5–2.5 |

While it is preferred to use a fluorosurfactant, such as FC95 manufactured by 3M Corp., as the wetting agent, other surfactants known in the art may be used provided that they keep the surface tension of the solution within the desired range.

If desired, additions may be made to the milling solutions so as to provide a beneficial effect on surface finish. These additions may comprise a material selected from the group consisting of urea, dissolved palladium metal, precious metals other than silver, and mixtures thereof. When urea is used, it may be present in an amount greater than about 20 grams/liter. When dissolved palladium is used, it may be present in an amount greater than about 10 ppm, preferably in an amount in the range of from about 50 ppm to about 200 ppm.

Figure 5:
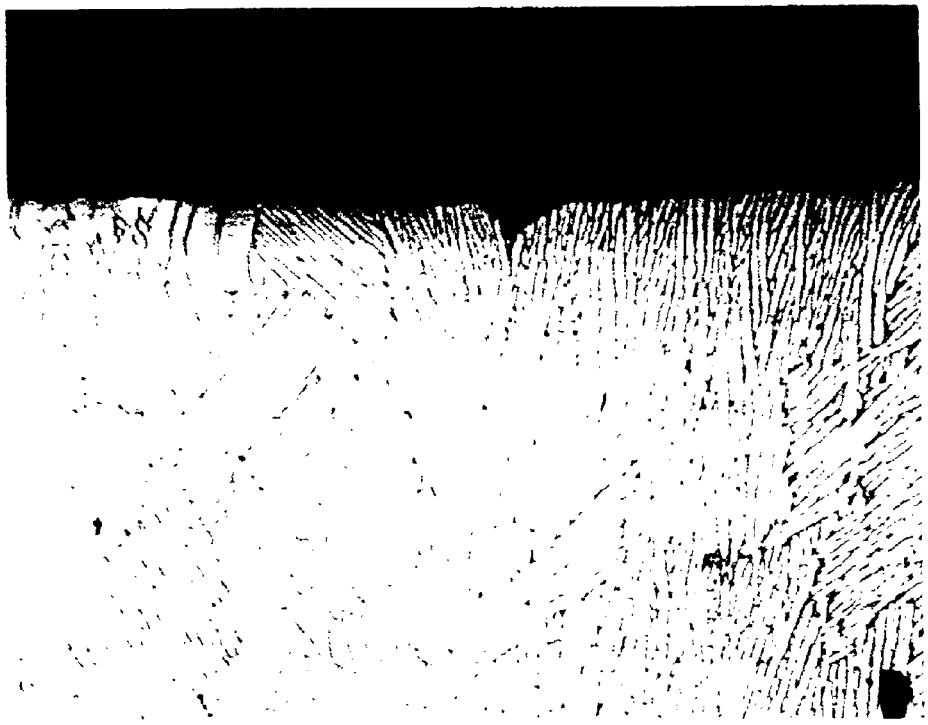
FIGS. 5 and 6 are photomicrographs showing the intergranular attack results of a titanium alloy part chemically milled in a standard titanium milling solution at 110° F. with removal being 0.020" per side at a magnification of 200×.
Figure 6:
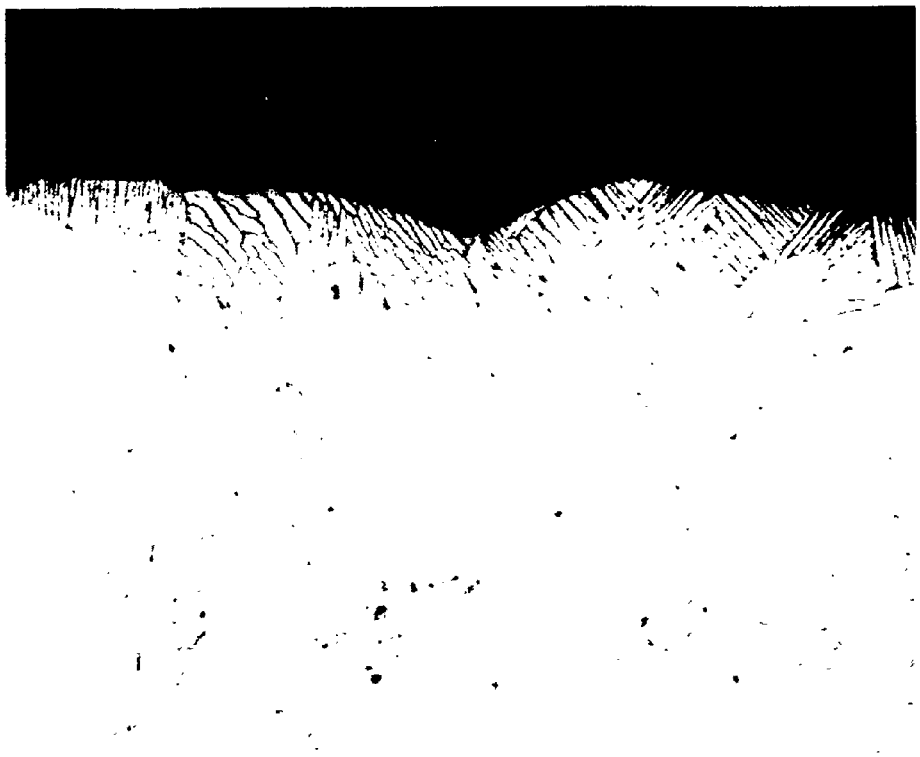
Figure 7:
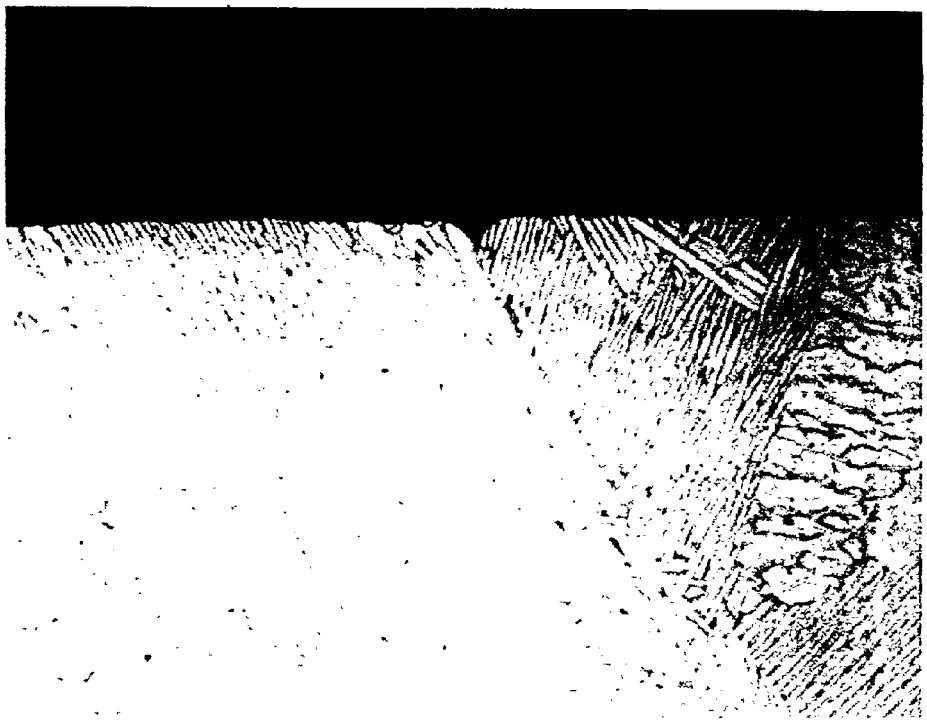
FIGS. 7 and 8 are photomicrographs showing the intergranular attack results of a titanium alloy part chemically milled in a standard titanium milling solution at 125° F. with removal being 0.020" per side at a magnification of 200×.
Figure 8:
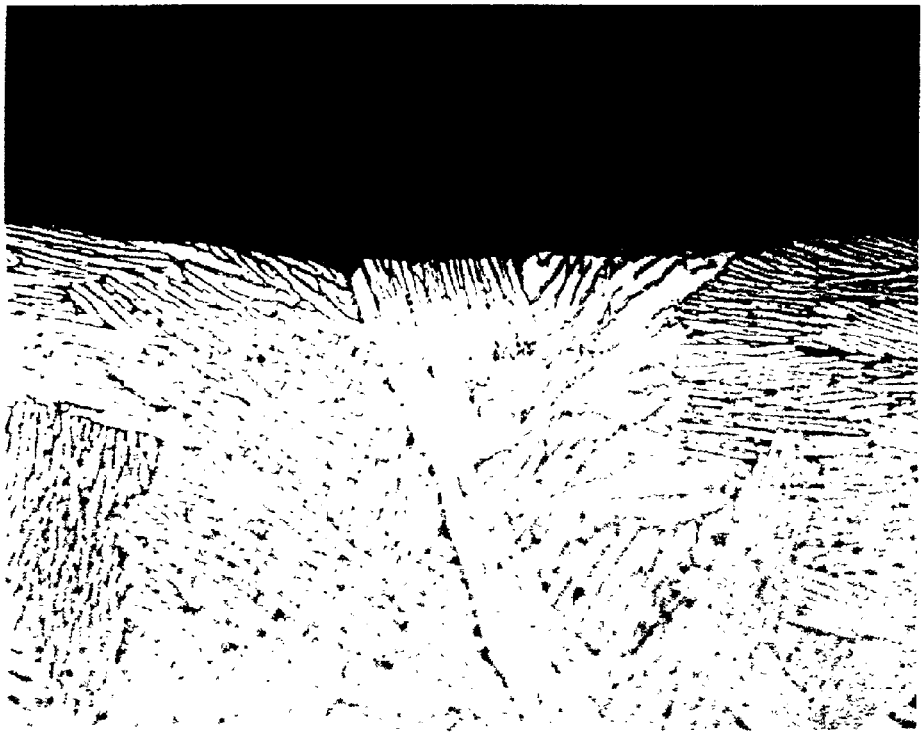

Two trials were conducted to demonstrate the significant reduction in intergranular attack which could be obtained through the use of chemical milling solutions in accordance with the present invention. The first trial was carried out using a milling solution containing 72 ml. (7.2 vol %) (70% conc.) nitric acid, 35 ml. (3.5 vol %) (70% conc.) hydrofluoric acid, 3 grams of dissolved titanium, surfactant in an amount sufficient to obtain a surface tension of 36 dynes/$cm^2$, and the balance water. The second trial was carried out using a solution which contained 72 ml. (7.2 vol %)(70% conc.) nitric acid, 48 ml. (4.8 vol %) (70% conc.) hydrofluoric acid, 3 grams of dissolved titanium, surfactant in an amount sufficient to obtain a surface tension of 36 dynes/$cm^2$, and the balance water. During each trial, the chemical milling solution was maintained at a temperature of 125° F. and a casting formed from a titanium 6-2-4-2 alloy was immersed in the solution. Photographs documenting the chemically milled surface from these trials are presented in FIGS. 1–4. The photomicrographs are a cross section through the chemically milled castings. The photomicrographs document the worst case intergranular attack produced by milling the castings in the trial solutions, which is 0.00015". By comparing the photomicrographs of FIGS. 1–4 with the photomicrographs of FIGS. 5–8, which show the results of a similar cast part which was chemically milled in a standard titanium solution at 110° F. and 125° F., it can be seen that the intergranular attack in FIGS. 1–4 is less than that which occurred when chemically milling the same type of castings in standard titanium solutions. FIGS. 5 and 6 show the worst intergranular attack to be 0.001" and FIGS. 7 and 8 show the worst intergranular attack to be 0.0005".

The results of the foregoing trials demonstrate that Ti 6-2-4-2 cast parts can be chemically milled with minimal intergranular attack. The intergranular attack for the solutions examined is less than 0.0002", the critical value of intergranular attack for full fatigue capability.

Milling solutions with a higher volume percent of acid, which maintain a $HNO_3$/HF ratio within the aforementioned ranges, and a low level of dissolved titanium are also workable. For example, such a solution could have 10.5 vol % nitric acid and 7.0 vol % hydrofluoric acid. The remaining ingredients in the solution, namely, the dissolved titanium, the surfactant, and the water are within the ranges described hereinbefore.

In one embodiment of a chemical milling solution, for one liter of solution, the solution contains 7.2 vol % nitric acid, 4.1 vol % hydrofluoric acid, up to 1.5 grams of dissolved titanium, a surfactant as required to reach a surface tension of 33 dynes/$cm^2$, and the balance water.

In yet another embodiment of a chemical milling solution, for one liter of solution, the solution contains 7.2 vol % of nitric acid, 4.8 vol % of hydrofluoric acid, dissolved titanium in an amount up to about 0.05 grams, a surfactant as required to reach a surface tension of about 36 dynes/$cm^2$, and the balance water.

In accordance with the process of the present invention, a milling solution containing nitric acid, hydrofluoric acid, a surfactant, dissolved titanium and water is prepared. The solution is then heated to a temperature in the range of from about 110° F. to about 130° F., preferably from about 115° F. to 125° F., and maintained at the temperature. The part formed from the titanium based alloy is then immersed in the milling solution, either fully or partially, for a time sufficient to remove a desired depth of material from at least one surface of the part.

While the milling solutions of the present invention have been found useful to chemically mill parts formed from Ti 6-2-4-2, the solutions could be used to mill parts formed from other titanium based alloys and other metal alloys. The milling solution of the present invention has been shown to have a beneficial effect on the surface finish of cast Ti 6-4 alloys (a titanium based alloy containing 6 wt % aluminum, 4 wt % vanadium, and the balance essentially titanium).

It is apparent that there has been provided in accordance with the present invention a chemical milling process and solution for cast titanium parts which fully satisfies the objects, means, and advantages set forth hereinbefore. While the present invention has been described in the context of specific embodiments thereof, other alternatives, modifications, and variations will become apparent to those skilled in the art having read the foregoing description. Therefore, it is intended to embrace those alternatives, modifications, and variations as fall within the broad scope of the appended claims.

What is claimed is:

1. A process for chemically milling a metal part comprising the steps of:

preparing a milling solution containing nitric acid, hydrofluoric acid, dissolved titanium, a wetting agent, and water;

said preparing step comprising providing said nitric acid and said hydrofluoric acid in a ratio of said nitric acid to said hydrofluoric acid in the range of from 1:1 to 2:1; thereafter, maintaining said milling solution at a temperature in the range of from 110 to 130° F.; and immersing said metal part into said milling solution for a time sufficient to mill a desired depth on at least one surface of said part.

2. A process according to claim 1, wherein said wetting agent comprises a surfactant and said milling solution preparing step comprises adding said surfactant to said milling solution in an amount that said milling solution has a surface tension of from about 30 dynes/$cm^2$ to about 36 dynes/$cm^2$.

3. A process according to claim 1, wherein the ratio of said nitric acid to hydrofluoric acid is in the range of from 1:1 to 1.5:1.

4. A process according to claim 1, wherein said milling solution preparing step comprises maintaining said dissolved titanium in an amount up to 2.5 oz./gal.

5. A process according to claim 4, wherein said milling solution preparing step comprises maintaining said dissolved titanium in an amount up to 0.5 oz./gal.

6. A process according to claim 4, wherein said milling solution preparing step comprises maintaining said dissolved titanium in an amount up to 1.5 oz./gal.

7. A process according to claim 4, wherein said milling solution preparing step comprises maintaining said dissolved titanium in an amount from 1.5 oz./gal. to 2.5 oz./gal.

8. A process according to claim 1, wherein said wetting agent comprises a fluorosurfactant.

9. A process according to claim 1, wherein said part is formed from a titanium alloy.

10. A process according to claim 1, further comprising adding to said solution at least one material which increases the milling rate of said solution.

11. A process according to claim 10, wherein said at least one material adding step comprises adding urea in an amount greater than 20 grams per liter.

12. A process according to claim 10, wherein said at least one material adding step comprises adding dissolved palladium in an amount greater than 10 ppm.

13. A process according to claim 12, wherein said at least one material adding step comprises adding said dissolved palladium in an amount in the range of from 50 ppm to 200 ppm.

14. A process according to claim 1, wherein said maintaining step comprises maintaining said solution at a temperature in the range of from 115° F. to 125° F.

15. A process for chemically milling a metal part comprising the steps of:

preparing a milling solution containing nitric acid, hydrofluoric acid, dissolved titanium, a wetting agent, and water;

said preparing step comprising providing said nitric acid and said hydrofluoric acid in a ratio of said nitric acid to said hydrofluoric acid in the range of from 1:1 to 2:1;

said preparing step further comprising adding said surfactant in an amount such that said milling solution has a surface tension of from 30 dynes/$cm^2$ to 36 dynes/$cm^2$; thereafter, maintaining said milling solution at a temperature in the range of from 110 to 130° F.; and immersing said metal part into said milling solution for a time sufficient to mill a desired depth on at least one surface of said part.

* * * * *

UNITED STATES PATENT AND TRADEMARK OFFICE

CERTIFICATE OF CORRECTION

PATENT NO. : 6,793,838 B2
DATED : September 21, 2004
INVENTOR(S) : James O. Hansen et al.

It is certified that error appears in the above-identified patent and that said Letters Patent is hereby corrected as shown below:

Column 4,
Line 34, delete "about" (both occurrences).

Signed and Sealed this

Thirteenth Day of June, 2006

JON W. DUDAS
*Director of the United States Patent and Trademark Office*